US006743238B2

(12) United States Patent
Caoduro

(10) Patent No.: US 6,743,238 B2
(45) Date of Patent: Jun. 1, 2004

(54) HAIR DEPILATING DEVICE

(76) Inventor: Juan Franco Caoduro, R. Naón 405, San Pedro (AR), 2930

( * ) Notice: Subject to any disclaimer, the term of this patent is extended or adjusted under 35 U.S.C. 154(b) by 149 days.

(21) Appl. No.: 10/155,813

(22) Filed: May 28, 2002

(65) Prior Publication Data

US 2003/0014059 A1 Jan. 16, 2003

(51) Int. Cl.[7] ..... A61B 17/50
(52) U.S. Cl. ..... 606/133
(58) Field of Search ..... 606/133, 134, 606/131; 452/42–45

(56) References Cited

U.S. PATENT DOCUMENTS 5,041,123 A * 8/1991 Oliveau et al. ..... 606/133
6,293,953 B1 * 9/2001 Kreutz et al. ..... 606/133
6,613,057 B1 * 9/2003 Obermann ..... 606/133

* cited by examiner

*Primary Examiner*—Kevin T. Truong

(57) ABSTRACT

A hair removal device providing the application of novel type of depilation hair-plucking assembly, comprising two helicoids with arranged helicoidal spaces as to define hair trap gaps conformed as continuous tweezers, the helicoids mounted in interleaved fashion and opposition so as to be parallel to one another and perpendicular to a central rototable shaft. One of said helicoids only rotates and the second one rotates together and reciprocates in opposition to the first helicoid. A converter device transforms rotation in a straight reciprocating motion applied to one of the helicoids that simultaneously opens a helicoidal gap and in cooperation with the second adjacent closes the other helicoidal gap and combined rotation extirpates superfluous hair.

4 Claims, 2 Drawing Sheets

HAIR DEPILATING DEVICE

CROSS-REFERENCE TO RELATED APPLICATIONS

This nonprovisional application was derived from the evolution of the idea exposed in the patent AR No. 254463 filed on Dec. 28, 1992 and patent No. WO/14355, filed Dec. 28, 1993 by the same inventor. In this machine a total novel hair-plucker head is presented.

BACKGROUND OF THE INVENTION

The present invention is related to a personal depilatory device for removing human body hair that comprises a housing conformed as a handle and as minimum mounted in the interior, an electric micro-motor, a mechanism converter of rotation in straight reciprocating motion and a rotary hair-plucker head that exhibits, externally of said housing, the active part that performs the depilation when taking contact with the hair to extirpate.

In the previous art several types of depilatory apparatuses are known. The first ones, of manual operation, have been displaced by the modern devices operated by means of electric motors as described in U.S. Pat. Nos. 4,524,722 and 4,931,054. These devices present hair-plucker head whose depilatory elements are composed mainly of a cylindrical helical spring or a cylinder of flexible or elastic material, bent in arch form in their assemblies in a such way that present a multiple quantity of peripheral grooves recipients of the hair, that operate as continuous pincers of extirpation when closing.

The apparatuses that possess said depilatory elements with curved axis of rotation, are limited in the rotary speed of the hair-plucker and the extraction of hair becomes slow and consequently a painful operation. A painless depilation is one of the most important quality that should hold a depilatory machine and this problem has not been totally resolved by the previous art. Some well-known depilatory apparatuses, although are conformed by hair-plucker head of high-speed and straight axis of rotation, however their construction is very complex and production becomes very expensive. Another inconvenience that present some of the devices of the previous art is due to the loop of the depilatory element built with a metallic wire of round section, catch the hair also of circular section, in two contact points only: if the applied clamping pressure is excessive, it can cut the hair without extirpating it and if the pressure is scanty, the hair disengages, but the tug produces a painful sensation.

A system different from the previously mentioned has been proposed in the French patent FR No. 2,334,320. This describes a depilatory device that uses two helical springs diametrically opposed and that are simultaneously impelled in rotation and reciprocally compressed and extended by means of cams. This apparatus is of a very complex and expensive construction; the design type also limits the rotating speed, that makes the depilation slow and painful. According to declaration of the inventor of the patent EP 0386327 A2, the apparatus has not reached the market for those limitations.

For all those records it would be desirable to obtain a depilatory machine of motorized type of simple construction, portable, personal and usable in any place of economic cost of production. It would be desirable also to provide a depilating machine with the maximum extirpation speed possible, to reduce the pain of the depilation.

BRIEF SUMMARY OF THE INVENTION

The present invention provides several new and original elements and improvements comparing with the devices of the previous art, what make simpler and more economic its production with an important increase of the manufacturing efficiency, like it will be described next.

The main improvements are obtained especially with the application of novel type of depilation hair-plucker head, comprising two helicoids sets conforming continuous tweezers, said helicoids mounted parallel disposed in a central rotatable shaft and fixed to it for rotation, in interleaved fashion and opposition so as to be parallel to one another and perpendicular to said central shaft with arranged helicoidal spaces as to define hair trap gaps between them and identified in accordance to the partially independent function accomplished as rotary-helicoid set, the one that only rotates and roto-reciprocating-helicoid set, the other one that rotates together and reciprocates in opposition to said first set. Said rotary hair-plucker head in its preferred embodiment is conformed by two helicoid sets made of metal, plastic, or another material, presenting the assembly a cylindrical form in the entire length.

Said depilation hair plucker head is made with the rotary-helicoid set incorporated to said central shaft and said roto-reciprocating-helicoid is interleaved coupled to set through its central hole by turning it as a screw and later enforced to rotation and free for reciprocating shifting by roller balls introduced in adecuate cavities of said shaft. As said, the rotary-helicoid set only rotate and said roto-reciprocating-helicoid set can shift reciprocally either way against opposing adjacent helicoidal surfaces in the axial direction so that helicoidal clamping gaps close twice in a reciprocating cycle. This is another important advantage fulfilled by this type of hair plucker head, obtained by clamping and extirpating superfluous hair twice each cycle. The number of clamping is dependent of the reciprocating cycles applied to the hair plucker head so as an additional improved performance is obtained increasing the quantity of clamping cycles, increasing the ratio per turn of continuous tweezers closures and the performance in the extraction of hair.

Another important improvement provided by the new types of helicoid tweezer of the hair-plucker head consists in the hair to depilate enters in the helicoidal openings and it is caught among the lateral faces of the helicoids, with lineal contact in the whole longitude holding it more firmly, avoiding the cutting.

Other of the most relevant advantages, purpose of the present invention, is provided by the straight axis of rotation and enforced cam follower that closes the tweezer, suitable for operating this depilatory device at relatively high speed unlike the prior art devices using spring return cam follower, noisy and requiring higher power consumption. A reciprocating converter transforms the motor rotation in straight reciprocation supplied to said roto-reciprocating helicoid set.

In accordance with the enunciated requirements, a favorite realization of the invention consists on a personal depilatory device for plucking superfluous human hair comprising, a housing conformed as handle, a hair-plucker head that exhibits externally an exposed portion which will contact the skin and the hair to extirpate.

Said depilatory hair-plucker head is formed by two different sets of helicoids, one with a pulley mounted in one end for rotation and the other mounting a collar for free rotation and reciprocating motion in the other end, both rotating jointly at high speed. During the operation, simultaneously with the rotation of both, an alternative axial displacement of the roto-reciprocating-helicoid set takes place in a direction and in the opposite and push against the respective adjacent rotary-helicoid surfaces, exercising a tweezer action, closing and opening up simultaneously two continuous helicoidal gaps among helicoids. The hair that grows in the surface of the skin enter, is caught and extirpated of root, for the clip action and rotation of the hair plucker head.

The depilatory hair plucker head rotates by means of pulley and belt or optionally meshed spur gears, that link it with the motor in one end, and in the other end, the fork and collar in cooperation with the reciprocating converter operate the axial trip of roto-reciprocating-helicoid set.

Many other favorite realizations of personal depilatory devices can be easily assembled by anyone skilled in the art using this same depilatory hair-plucker head and the different reciprocating means already reported in the afore mentioned patent of this inventor.

BRIEF DESCRIPTION OF SEVERAL VIEWS OF THE DRAWINGS

The invention is explained later in details with reference to the drawings, in those which, each particular realization is represented (not in scale) without the intention of restricting the invention to these illustrations.

DETAILED DESCRIPTION OF INVENTION

The personal depilating device can be defined as made up of three functional groups, each one identified for the task that carries out being the hair-plucker head the primary group, and being two auxiliary functional groups, the motor that provides the motive force and the reciprocating converter that transforms the rotation in movement of straight reciprocating motion. The three groups are shielded by a housing that works as an handle, which leaves open part of the hair-plucker head that produces the depilation.

The primary functional element that is to say the hair plucker head is integrated by two parts, one defined as the rotary-helicoid set and the other as roto-reciprocating helicoid set: the union of the two parts composes the hair-plucker head of the personal depilating device. The rotary-helicoid set operates only on rotation and the roto-reciprocating helicoids set actuates on rotation and simultaneous reciprocation, closing the gaps between adjacent helicoids twice each reciprocating cycle.

The operative sequence starts from the motor that transmits the rotation by means of a flexible belt (or gears: not shown), to the pulley of the hair-plucker head, incorporated to the central rotatable shaft and said rotary-helicoid set. Simultaneously, motor rotation is transmitted by a second belt to the reciprocating convertor which transform a turn cycle in straight reciprocating motion cycle, that is a back and forth trip applied to the fork introduced in the collar groove of the rotary-reciprocating helicoid set.

Said hair-plucker head, exhibits a helicoidal gap produced between opposing helicoids of the two different types of helicoids set. It can be appreciated as, by means of a reciprocating axial displacement, said roto-reciprocating helicoids closes as tweezer the helicoidal gap in cooperation with an adjacent rotary-helicoid lateral surface in one direction and with the other adjacent, in the opposite direction, in the subsequent reciprocating half cycle.

Said depilatory hair-plucker simultaneously driven in rotation and straight reciprocating motion, simultaneously closes and opens the two continuous helicoidal gaps in its outline surface that traps and with rotation cooperation, extirpates off roots the superfluous hair.

Figure 1:
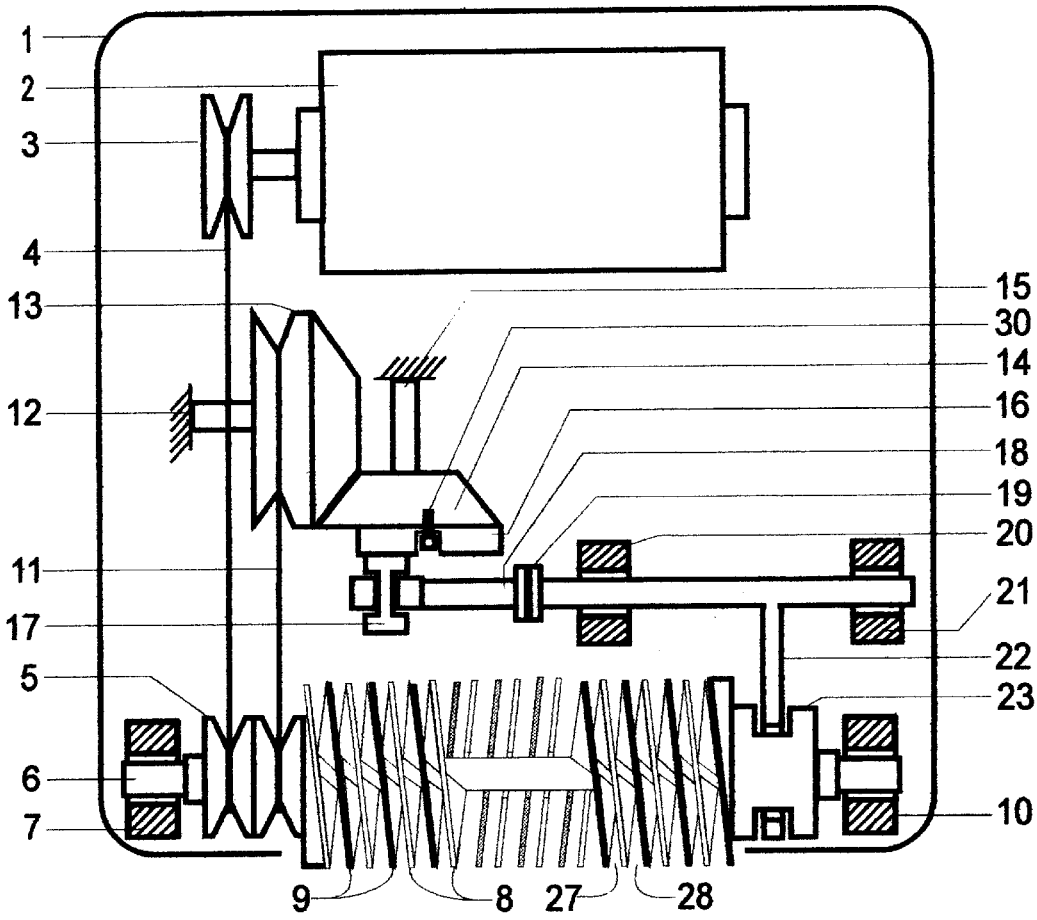
FIG. 1 is a lateral illustrative cross-sectional view that shows a form of the hair depilating device made in accordance with the present invention.

The hair depilating device illustrated in the FIG. 1 of the drawings comprises the housing (1), the electric motor (2) that exhibits the driver pulley (3) and the belt (4) that connects the motor to the double-pulley (5) of the hair-plucker head that also exhibits the following elements: the shaft (6), supported in the bearings (7) and (10), the rotary-helicoid set (8), incorporated to said shaft (6) and the roto-reciprocating helicoids set (9) comprising the collar (23). Said two helicoids generate the helical gaps (27) and (28), active elements of the hair plucker head.

The second groove of the pulley (5) connects by means of the belt (11) the pulley-bevel-gear (13) meshed to the bevel-gear (14) of the reciprocating converter conformed by the pivot (15), the regulating-disk (16) its center-pivot (30), that exhibits the crank (17) of adjustable eccentricity, coupled to the crank-rod (18) and connected by the articulation (19) to the fork (22) inserted in the groove of the collar (23) and supported by the bearings (20) and (21).

Figure 2:
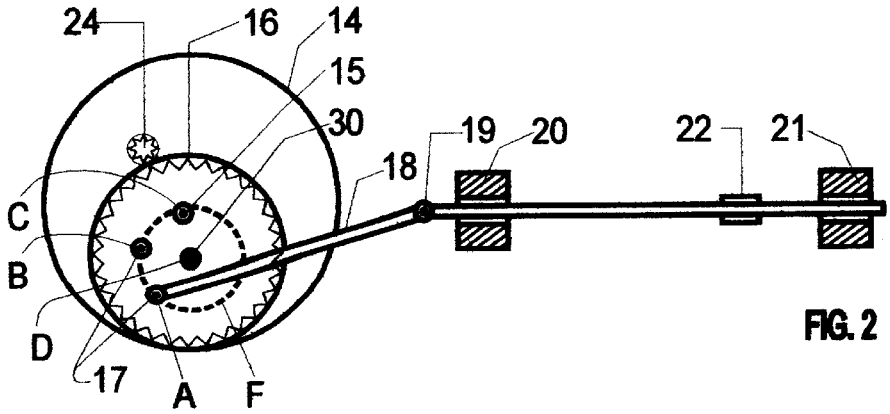
FIG. 2 is an enlarged partial bottom view of FIG. 1, of the reciprocating converter that transforms the rotation into a movement of a straight reciprocating motion.

FIG. 2 illustrates in an enlarged plant view the details of the reciprocating converter composed by the bevel gear (14) whose rotation center is C coincident with the pivot (15) and mounted on top of said bevel gear, the spur gear (24) meshed with the toothed disk (16) whose center of rotation on point D is coincident with the pivot (30). The spur gear (24), provides a fine regulation of the crank (17) by fixing it, as an example, in the different points A, D, C and intermediated by variation of its eccentricity represented for the longitude of the segments A–C, B–C or other points following the circuit of the circumference F.

Figure 4:
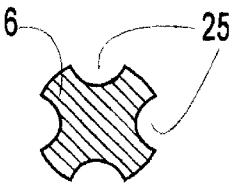
FIG. 4 is an enlarged right cross-sectional view along line a—a of FIG. 3.
Figure 3:
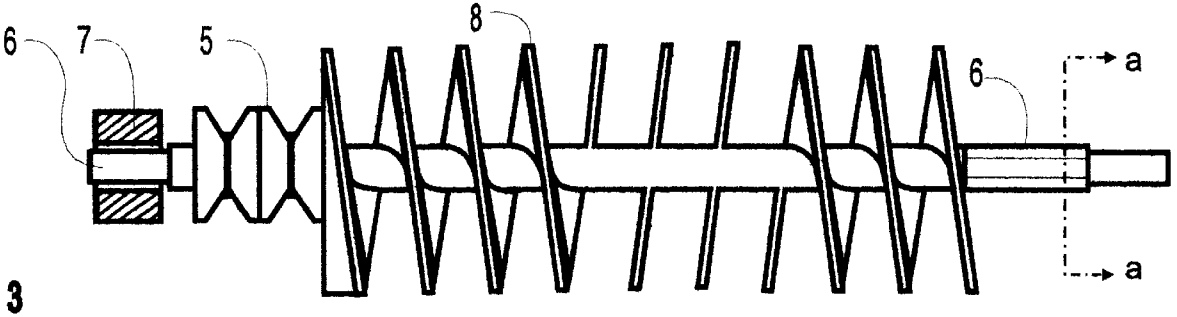
FIG. 3 is an enlarged view of a partial element of the hair-plucker head illustrated in FIG. 1, comprising the rotary-helicoid set with the driven pulley and central shaft.

FIG. 3 is an enlarged side view of the rotating-helicoid set (8) with the incorporated pulley (5) and the axis (6). FIG. 4 is a cross-sectional view along line a—a of FIG. 3 exhibiting the concavities (25) to lodge roller balls (32) for providing shifting and rotating motion to said roto-reciprocating-helicoid set.

Figure 6:
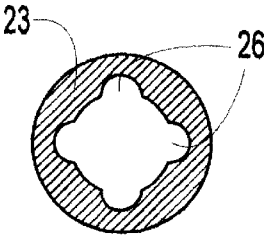
FIG. 6 is an enlarged right cross-sectional view along line b—b of FIG. 6.
Figure 5:
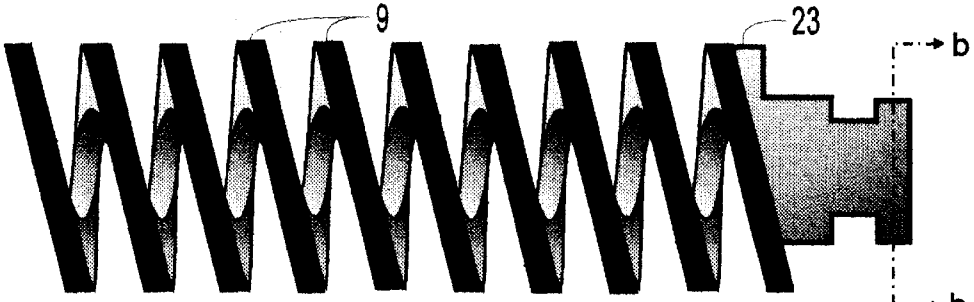
FIG. 5 is an enlarged view of a partial element of the hair-plucker head illustrated in FIG. 1, comprising the roto-reciprocating-helicoid set with the collar.

FIG. 5 represents an enlarged side view of the roto-reciprocating helicoid set (9) and its collar (23). FIG. 6 represents a cross-sectional view along line b—b of FIG. 5 exhibiting concave grooves (26) coincident with said concave grooves (25) to lodge said roller balls (32).

Figure 8:
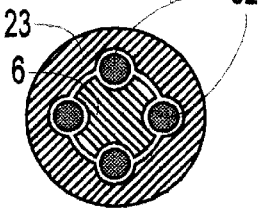
FIG. 8 is an enlarged right cross-sectional view along line c—c of FIG. 7.
Figure 7:
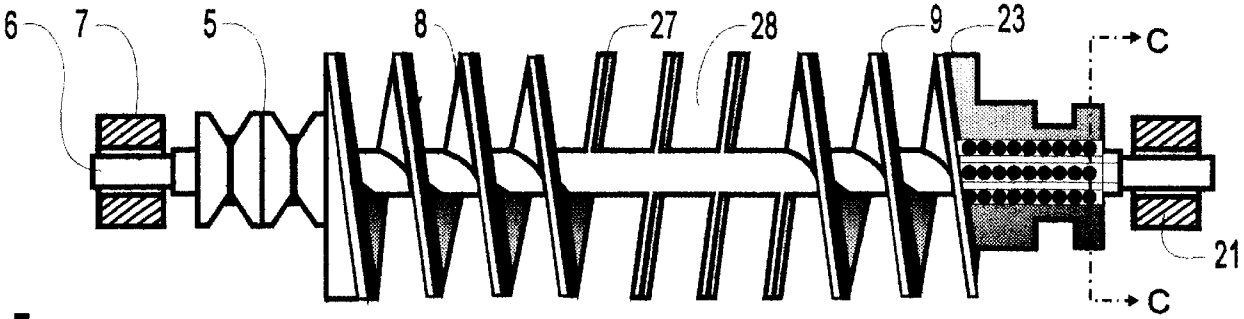
FIG. 7 is an enlarged side view of the hair-plucker head embodiment illustrated in FIG. 1, assembled with all its detailed components represented in FIGS. 2, 3, 5.

FIG. 7 represent the hair-plucker head embodiment with the two helicoids (8) and (9) inserted the one inside the other one, complete with their elements, exhibiting the helical gaps (27) in a closing position and helical gaps (28) wide open. FIG. 8 as a cross-sectional view along line c—c of FIG. 7 exhibits the shaft (6) and the fork (23) bounded by the roller balls (32) to rotation and shifting. The axial shifting of the helicoids (9) leftward presses its lateral surface against the lateral surface of helicoids (8) closing the helical groove (27) and simultaneously opening the adjacent helical gap (28), they catch the superfluous hair and the rotation extirpates them.

The invention has been described regarding to certain specific embodiments, however it is to be understood that the description is not meant as a limitation since further other modifications and applications of the invention can be made by those skilled in the art and it is intended to cover such modifications and applications as fall within the scope of appended claims.

What I claim as my invention is:

1. A dual-helicoids rotary hair-plucker head depilatory device for removing human body hair comprising in combination:

a manually-grippable housing;

dual-helicoids rotary hair-plucker head means protruding from said housing comprising two helicoids set conforming continuous tweezers, said helicoids mounted in central rototable shaft in interleaved fashion and opposition so as to be parallel to one another, with arranged helicoidal spaces as to define hair trap gaps inbetween and said helicoids set identified in accordance to the partially independent function accomplished as rotary-helicoid set the one that only rotates and roto-reciprocating-helicoid set the other one that rotates together and reciprocates in opposition to said first helicoid set, both perpendicular to said central rototable shaft within said housing and said shaft substantially parallel to an area of skin from which hair is to be removed;

a reciprocating converter means that transforms motor rotation into straight reciprocation trip for opening and closing said hair trap gaps and means for regulating the length of said trip supplied to the roto-reciprocating-helicoid set;

a micro-motor disposed in said housing and being arranged to rotate said rotary hair plucker head means and supplies motion to said reciprocating converter.

2. The device of claim 1 wherein said dual-helicoids roto-reciprocating-helicoid set rotary hair-plucker head comprises a rotary-helicoids set made of metal or plastic material with incorporated a dual-groove pulley mounted on the left side including a central rototable shaft and said shaft having on the right side longitudinal concavities for lodging rolling balls means in coincidence with similar concavities of said roto-reciprocating-helicoid set, for its reciprocation and rotation motion.

3. The device of claim 1 wherein said dual-helicoids rotary hair-plucker head comprises a roto-reciprocating-helicoid set made of metal or plastic material holding a central axial for passage of said central rotatable shaft said borehole included through an incorporated collar with internal concavities in coincidence with said similar concavities of said central rotatable shaft for reciprocation and rotation motion of said roto-reciprocating-helicoid set and said collar comprises a peripheral groove adequate to reciprocating fork operation.

4. The device of claim 1 wherein said reciprocating converter means composed by a small spur gear (24) meshed with a toothed disk mounts a crank of variable regulating eccentricity such that a connected rod-crank means causes the trip regulation of said fork that operates said collar that produces a fine regulation of said reciprocating trip causing said roto-reciprocating-helicoid set close and open helicoids gaps.

* * * * *